United States Patent [19]

Legatt

[11] Patent Number: 4,947,503

[45] Date of Patent: Aug. 14, 1990

[54] MOBILE FLOOR TREATING MACHINE

[75] Inventor: Donald J. Legatt, St. Michael, Minn.

[73] Assignee: Advance Machine Company, Plymouth, Minn.

[21] Appl. No.: 320,176

[22] Filed: Mar. 7, 1989

[51] Int. Cl.[5] ..... A47L 11/283; A47L 11/40

[52] U.S. Cl. ..... 15/49.1; 51/177; 180/6.32

[58] Field of Search ..... 15/49 R, 50 R, 49 C, 15/50 C, 98, 385, 389; 51/176, 177; 180/6.2, 6.26, 6.32

[56] References Cited

U.S. PATENT DOCUMENTS

| | | | |
|---|---|---|---|
| 2,978,719 | 4/1961 | Arones | 15/49 R |
| 3,781,937 | 1/1974 | Jacobs | 15/49 R |
| 4,136,491 | 1/1979 | Redifer | 15/49 R |
| 4,312,603 | 1/1982 | Whiteman, Jr. | 15/49 R X |
| 4,727,686 | 3/1988 | Persson | 15/49 R X |
| 4,763,741 | 8/1988 | Torta | 15/50 R |

*Primary Examiner*—Edward L. Roberts

*Attorney, Agent, or Firm*—Peterson, Wicks, Nemer & Kamrath

[57] ABSTRACT

A steering mechanism (14) and a locking mechanism (80) are disclosed in their most preferred form for use in a mobile floor treating machine (10) including first and second handles (68, 70) which are pivotally mounted to the machine chassis (12). The handles (68, 70) pivot L-shaped levers (28, 46) which are pivotably mounted to a bracket (58) which is connected to the gear box for rotating treating members (16, 18). The bearing blocks (22) of the shafts (20) of the treating members (16, 18) are pivotably connected via spherical rod ends (36, 52) to the horizontal legs (26) of the levers (28, 46). Therefore, the shafts (20) and thus treating members (16, 18) can be tilted to create a pressure differential on the contact area of the treating members (16, 18) with the floor surface. The pressure differential creates a corresponding differential in the frictional contact of the treating members (16, 18) with the floor surface which then urges the machine (10) in a direction opposite the direction the treating member (16, 18) is rotating. The locking mechanism (80) includes a plunger (86) which is selectively slideably mounted in a tube (82) of the first handle (68) into a tube (84) of the second handle (70). The plunger (86) is biased into the tube (82) and in a noninterlocking position with handle (70) by a tension spring (92) anchored between the tube (82) and the plunger (86). The plunger (86) is slid within the tube (82) by a knob (88) which is attached to the plunger (86) and extends through an elongated slot (90) formed in the tube (82).

15 Claims, 1 Drawing Sheet

MOBILE FLOOR TREATING MACHINE

BACKGROUND

The present invention generally relates to steering mechanisms for mobile treating machines and to locking mechanisms for interlocking first and second pivotal handles, with the present invention being illustrated in its preferred form of a mobile floor treating machine.

The advent of mobile floor treating machines of the type described in U.S. Pat. No. 2,978,719 where the floor treating members not only treat the floor but provide the propelling force removed the need for wheel drive systems without requiring the operator to push or pull the machine over the floor surface. It can further be appreciated that such machines are of great mass due to the weight of their components and often are energized by batteries which further compound the mass of the machine. Although the effort required by the operator to move the machine forward or in reverse on the floor surface is greatly reduced or effectively eliminated by the construction described in U.S. Pat. No. 2,978,719, it can be appreciated that significant effort must still be exerted by the operator to maneuver the machine from a straight line path such as to turn a corner or to move to another cleaning path. Thus, a need has arisen for a steering mechanism for reducing the effort required to maneuver the machine.

Further, in the most preferred form of the steering mechanism, first and second pivotal handles are utilized to control the directional!reaction created. Thus, a further need has arisen to!selectively interlock the handles to allow operation!of the machine in a manner similar to existing mobile!floor treating machines when operating along a straight line cleaning path and to allow the handles to be separate]y activated to maneuver the machine out of the straight line cleaning path.

SUMMARY

The present invention solves these needs and other problems encountered in the field of mobile treating machines by providing, in first aspect of the present invention, a steering mechanism for mobile treating machines. The mobile treating machine includes first and second treating members located on opposite sides of the longitudinal axis of the machine and which are manipulated independently of the chassis whereby portions of each treating member contact the surface to be treated with greater pressure than other portions to cause the machine to move forward or rearwardly on the surface while simultaneously treating the surface. The present invention is characterized by members for manipulating the treating members independently of each other including members for manipulating the first treating member between a neutral position, a first driving position, and a second driving position, and members for manipulating the second treating member between a neutral position, a first driving position, and a second driving position. The treating members engage the surface with equal pressure throughout in their neutral positions. The outer portions of the treating members exert a greater pressure than the inner portions of the treating members in the first driving positions of the first and second treating members. The inner portions of the treating members exert a greater pressure than the outer portions of the treating members in the second driving position of the first and second treating members. Thus, by manipulating the first and second treating members, a directional reaction is produced to cause the machine to move upon the surface.

In another aspect of the present invention, a locking mechanism is provided for removably interlocking first and second handles which are pivotably mounted about an axis. The present invention is characterized by a first tube, a second tube, a plunger slideably mounted in the first tube, and members for sliding the plunger in the first tube. The first tube has a first, open end and is interconnected to the first handle generally parallel to and spaced from the axis. The second tube has a first, open end and is interconnected to the second handle generally parallel to the axis and spaced from the axis generally equal to the spacing of the first tube from the axis. The plunger is slideable between a first, interlocking position extending out of the open end of the first tube and a second, noninterlocking position. The plunger is receivable in the open end of the second tube in the first, interlocking position while the plunger is in a noninterlocking relation with the pivoting of the second handle in the second, noninterlocking position.

It is thus an object of the present invention to provide a novel steering mechanism for a mobile treating machine.

It is thus an object of the present invention to provide a novel locking mechanism for removably interlocking pivotably mounted handles together.

It is further an object of the present invention to provide such a novel steering mechanism which reduces the effort required to maneuver a mobile treating machine.

It is further an object of the present invention to provide such a novel steering mechanism which independently tilts rotating treating members of the mobile treating machine to create a pressure differential on the treating contact area which creates a corresponding differential in frictional contact which in turn creates a driving force reaction.

It is further an object of the present invention to provide such a novel steering mechanism which is of a simple, mechanical construction.

It is further an object of the present invention to provide such a novel locking mechanism which is of a simple, mechanical construction.

It is further an object of the present invention to provide such a novel locking mechanism which is simple to operate while simultaneously pivoting the handles.

It is further an object of the present invention to provide such a novel locking mechanism which is biased into a noninterlocking position.

It is further an object of the present invention to provide such a novel locking mechanism which is easily accessible to the operator when his hands are grasping the handles.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
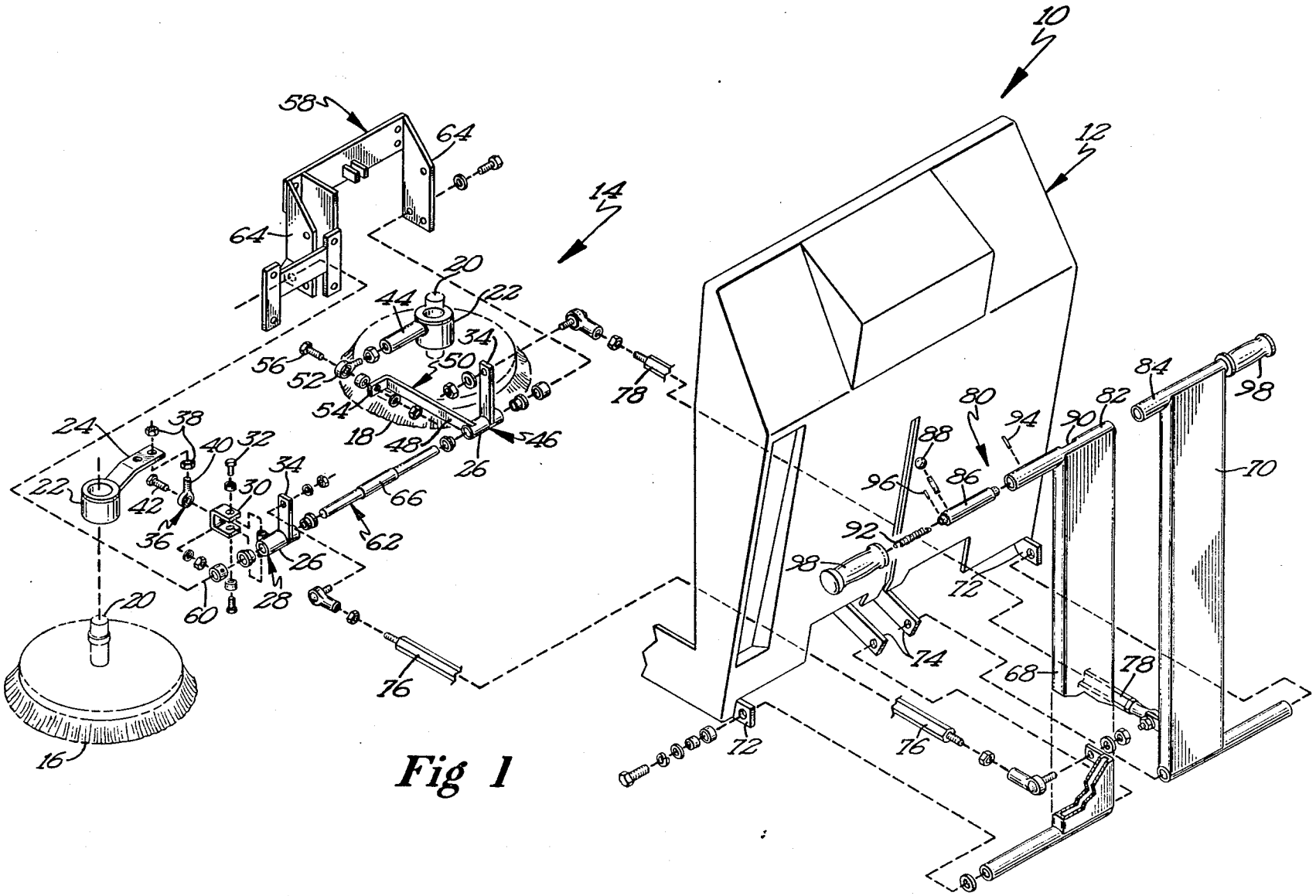
FIG. 1 shows a partial, exploded perspective view of a floor maintenance machine according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "upper", "lower", "first", "second", "free", "longitudinal", "right", "left", "front", "rear", "end", "edge", "forward", "inside", "outside", and similar terms are used herein, it should be understood that these terms have reference only to the structure shown in the drawings as it would appear to a person viewing the drawings and are utilized only to facilitate describing the invention.

DESCRIPTION

A floor machine is shown in the drawings in its most preferred form as a floor maintenance machine according to the teachings of the present invention and is generally designated 10. Floor maintenance machine 10 generally includes a chassis 12 adapted to be moved along a floor or other cleaning surface such as by wheels, not shown. Left and right treating members 16 and 18 for treating the floor surface when rotated about an axis when chassis 12 is moved along the floor are provided in its most preferred form arranged to not only treat the floor surface, but also to provide the propelling force which moves machine 10 either forward or in reverse over the floor surface in a manner as disclosed in U.S. Pat. No. 2,978,719. According to the teachings of the present invention, a steering mechanism 14 is provided for machine 10 by tilting floor treating members 16 and 18 relative to each other to create a pressure differential between members 16 and 18 causing a propelling reaction which may be utilized to maneuver machine 10.

Specifically, rotatable shaft 20 of left treating member 16 extends through a bearing block 22 having an integral tab 24 extending generally perpendicular to the polishing axis of shaft 20. Tab 24 of bearing block 22 is adjustably pivotably connected to a horizontal leg 26 of a first L-shaped lever 28. Specifically, in the most preferred form, a C-shaped yoke 30 is provided having the free ends of its legs adjustably pivotably mounted to leg 26 along an axis 32 which is generally perpendicular to leg 26 and generally parallel to but spaced from a vertical leg 34 of lever 28 and generally parallel to but spaced from shaft 20 of treating member 16. A spherical rod end 36 is adjustably secured to tab 24 by nuts 38 threadably received on the threaded rod 40 of rod end 36 which passes through tab 24 generally parallel to but spaced from shaft 20 located in bearing block 22. Rod end 36 is pivotably connected to the central portion of yoke 30 by a bolt 42 extending therebetween generally perpendicular to legs 26 and 34 of lever 28.

Similarly, rotatable shaft 20 of right treating member 18 extends through bearing block 22 having an integral arm 44 extending generally perpendicular to the polishing axis of shaft 20 of member 18. Arm 44 is adjustably pivotably connected to horizontal leg 26 of a second L-shaped lever 46. Specifically, in the most preferred form, the free end of the elongated leg 48 of an L-shaped plate 50 is integrally secured to leg 26 generally perpendicular to leg 26 and generally perpendicular to leg 34 of lever 46. A spherical rod end 52 is threaded into the free end of arm 44 generally perpendicular to rotatable shaft 20 of treating member 18 located in bearing block 22. Rod end 52 is adjustably pivotably connected to leg 54 of plate 50 by a bolt 56 extending therebetween generally perpendicular to legs 26 and 34 of lever 46.

Levers 28 and 46 are pivotably mounted to gear box bracket 58 along an axis 60 which is parallel to and defined by horizontal legs 26. In the most preferred form, legs 26 are cylindrical in shape and are rotatably received on a shaft 62 fixed between side plates 64 of bracket 58. In the most preferred form, shaft 62 includes an elongated diameter central portion 66 for separating and maintaining legs 26 of levers 28 and 46 on shaft 62, with suitable bushings being provided to reduce friction.

It can be appreciated that bracket 58 and the gear box, not shown, which is mounted thereto can be raised and lowered relative to chassis 12 for purposes of raising and lowering treating members 16 and 18 relative to the floor surface to engage the floor surface at the desired pressure or to be spaced above the floor surface. Shafts 20 of treating members 16 and 18 may be attached to output shafts of the gear box mounted to bracket 58 by universal flexible couplings not shown to allow tilting of treating members 16 and 18 relative to bracket 58 and the gear box mounted thereto.

In the most preferred form of the present invention, members 16 and 18 are manually tilted relative to bracket 58 by upright handles 68 and 70 which are pivotally mounted by their lower ends between ears 72 and 74 extending from chassis 12. Legs 34 of levers 28 and 46 are interconnected to handles 68 and 70 in the most preferred for by turnbuckle assemblies 76 and 78 having their first ends pivotally connected to the free ends of legs 34 and their second ends pivotally connected to handles 68 and 70 intermediate their upper and lower ends.

According to the preferred teachings of the present invention, a locking mechanism 80 is provided for interlocking handles 68 and 70 together for pivotable movement about their lower ends. Specifically, in the most preferred form, the upper ends of handles 68 and 70 terminate in horizontal tubes 82 and 84 which are parallel to and spaced from the pivot axis of handles 68 and 70 to chassis 12. A plunger 86 is slideably mounted in tube 82 to extend into tube 84. A knob 88 is attached to plunger 86 through a longitudinal slot 90, formed in tube 82.

A spring 92 is provided for moving or biasing plunger 86 into tube 82 and in a position not extending into tube 84. Specifically, the first end of spring 92 is retained relative to tube 8 by a pin 94 secured to tube 82 and the second end of spring 92 is retained relative to plunger 86 by a pin 96, secured to plunger 86. Thus, in a normal condition, plunger 86 is biased into tube 82 and out from tube 84 by spring 92 such that handles 68 and 70 are independent of each other. Plunger 86 may be manually slid in tube 82 against the bias of spring 92 by pushing on knob 88 until plunger 86 extends out of the open end of tube 82 and into the open end of tube 84 and thus interlocking handles 68 and 70 together to work in unison. Slot 90 may include a perpendicular portion to allow knob 88 to be rotated in tube 82 about plunger 86 such that plunger 86 can be locked in its interlocking position. Grip members 98 may be slid over the opposite ends of tubes 82 and 84, if desired.

Now that the basic construction of floor machine 10 according to the preferred teachings of the present invention has been explained, the operation and subtle features of floor machine 10 can be set forth and appreciated. Specifically, treating member 16 is rotated in a clockwise direction and treating member 18 is rotated in a counter clockwise direction. There is a slight overlap of the inner portions of treating members 16 and 18 so that a continuous path is covered, with both treating members 16 and 18 being in contact with the floor surface. The amount of pressure of treating members 16 and 18 may be regulated in any desired manner. With handles 68 and 70 in their normal position, treating members 16 and 18 contact the floor surface with equal pressure throughout so that treating members 16 and 18 merely rotate in contact with the floor surface, with machine 10 remaining stationary according to the teachings of the present invention.

As treating members 16 and 18 are tilted, greater amounts of pressure are placed on portion of treating members 16 and 18 to create a pressure differential on the full contact area of treating members 16 and 18. This pressure differential causes a corresponding differential in the frictional contact of treating members 16 and 18 with the floor surface to thus cause machine 10 to be urged in the direction opposite the direction treating members 16 and 18 are rotating at the point of higher frictional contact. Thus, when handles 68 and 70 are pushed forward, treating members 16 and 18 are tilted to place a greater pressure on the inner portions thereof to urge machine 10 forward due to the clockwise direction of rotation of treating member 16 and the counter clockwise direction of rotation of treating member 18. Conversely, when handles 68 and 70 are pulled rearward, treating members 16 and 18 are tilted to place a greater pressure on the outer portions thereof to urge machine 10 in reverse due to the clockwise direction of rotation of treating member 16 and the counter clockwise direction of rotation of treating member 18. It can be appreciated that handles 68 and 70 may be pushed forward or pulled rearward as a single, interlocked unit utilizing locking mechanism 80.

Additionally, in the preferred teachings of the present invention, treating members 16 and 18 may be tilted individually by the individual manipulation of handles 68 and 70 in the most preferred form to reduce the effort required to maneuver floor machine 10 according to the teachings of the present invention. For example, floor machine 10 can be turned to the right by pushing handle 68 forward to tilt treating member 16 to place a greater pressure n the inner portion thereof to create a forward driving force due to the clockwise direction of rotation of treating member 16. Simultaneously, handle 70 may be allowed to remain in its normal position such that treating member 18 contacts the floor surface with equal pressure throughout and not tending to create a force for drawing floor machine 10 along the floor surface. Since the forward driving force created by treating member 16 located on the left side of the longitudinal axis of floor machine 10 is not balanced by a forward driving force created by treating member 18 located on the right side of the longitudinal axis of floor machine 10, floor machine 10 will have a tendency to turn to the right according to the teachings of the present invention. Similarly, floor machine 10 can be turned to the right by pulling handle 7 rearward to tilt treating member 18 to place a greater pressure on the outer portion thereof to create a rearward driving force due to the counter clockwise direction of rotation of treating member 18. Simultaneously, handle 68 may be allowed to remain in its normal position such that treating member 16 contacts the floor surface with equal pressure throughout and not tending to create a force for drawing floor machine 10 along the floor surface. Since the rearward driving fore created by treating member 18 located on the right side of the longitudinal axis of floor machine 10 is not balanced by a rearward driving force created by treating member 16 located on the left side of the longitudinal axis of floor machine 10, floor machine 10 will have a tendency to turn to the right according to the teachings of the present invention. Further, it can be appreciated that the right turn directional reaction can be enhanced by pushing handle 68 forward to tilt treating ember 16 to place a greater pressure on the inner portion thereof to create a forward driving force due to the clockwise direction of rotation of treating member 16 while simultaneously pulling handle 70 rearward to tilt treating member 18 to place a greater pressure on the outer potion thereof to create a rearward driving force de to the counter clockwise direction of rotation of treating member 18. Similarly, floor machine 10 according to the teachings of the present invention can be turned to the left by leaving handle 68 in its normal position or by pulling it rearward while simultaneously pushing handle 70 forward or leaving it in its normal position.

It can be appreciate that although treating members 16 and 18 are tilted by manipulation of handles 68 and 70, the entire treating surfaces of treating members 16 and 18 remain in contact with the floor surface at all times, with a pressure differential created on the full contact area of treating embers 16 and 18. A pressure differential creates a corresponding differential in frictional contact creating the driving force utilized to maneuver floor machine 10 according to the teachings of the present invention.

It can be appreciated that steering mechanism 14 according to the teachings of the present invention is advantageous for several reasons. First, the effort required by the operator to maneuver machine 10 out of a straight line cleaning path to turn a corner or to move to another cleaning path is greatly reduced utilizing steering mechanism 14 according to the teachings of the present invention. Further, steering mechanism 14 is of a simple, mechanical construction which is easy to manufacture and assemble and which is easy to operate by the machine operator.

Likewise, locking mechanism 80 according to the teachings of the present invention is advantageous for several reasons. First, knob 88 is easily accessible to the operator's hands grasping grip members 98. Further, locking mechanism 80 is simple to operate as knob 88 may be easily pushed by the thumb of the operator located on handle 68, with knob 88 being biased to return plunger 86 to its noninterlocking position when not being pushed by the operator. Additionally, locking mechanism 80 is of a simple, mechanical construction which is easy to manufacture and assemble.

Now that the basic teachings of the present invention have been explained, many extensions and variations will be obvious to one having ordinary skill in the art. For example, it is often desired to transport floor machine 10 to different floor surfaces to be treated with treating members 16 and 18 in a nonengaging condition with the floor. As it is necessary for the treating members 16 and 18 to contact the floor surface to create a driving or propelling force, floor machine 10 may include other provisions for propelling chassis 12 along the floor separately from or in conjunction with the propulsion created by treating members 16 and 18 according to the teachings of the present invention. Further, such propelling provisions may be controlled by pivoting handles 68 and 70, if desired.

Although treating members 16 and 18 are shown in the most preferred form as brushes, treating members 16 and 18 according to the teachings of the present invention can be any of the known floor treating types such as but not limited to grinding, scrubbing, polishing, or surfacing discs, and provisions may be included to allow interchange of different types of treating members 16 and 18 in machine 10.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. In a mobile treating machine including rotating, first and second treating members which are manipulated independently of the chassis whereby portions of each treating member contact the surface to be treated with greater pressure than other portions to cause the machine to move forward or rearwardly on the surface while simultaneously treating the surface, with the treating members being located on opposite sides of the longitudinal axis of the machine, a steering mechanism for reducing the effort required to maneuver the machine on the surface comprising, in combination: means for manipulating the treating members independently of each other including means for manipulating the first treating member between a neutral position, a first driving position, and a second driving position, and means for manipulating the second treating member between a neutral position, a first driving position, and a second driving position, with the treating members engaging the surface with equal pressure throughout in their neutral positions, with the outer portions of the treating members exerting a greater pressure than the inner portions of the treating members in the first driving positions of the first and second treating members, with the inner portions of the treating members exerting a greater pressure than the outer' portions of the treating members in the second driving position of the first and second treating members, whereby by manipulating the first and second treating members a directional reaction is produced to cause the machine to move upon the surface.

2. The mobile treating machine of claim 1 wherein the first treating member rotates in a clockwise direction and the second treating member rotates in a counter clockwise direction, with the manipulation of the first and second treating members into their first driving positions causing a rearward driving force.

3. The mobile treating machine of claim 2 wherein the manipulating means comprises, in combination: a lever having a first leg, with the lever being pivotally mounted about its first leg, with the rotatable treating member being pivotally connected to the first leg about a connection axis generally perpendicular to the rotation axis of the treating member and to the first leg; and means for pivoting the lever about its first leg.

4. The mobile-treating machine of claim 3 wherein the pivoting means comprises, in combination: a handle pivotably mounted to the chassis, with the lever being L-shaped and including a second leg; and means for interconnecting the handle with the second leg of the lever.

5. The mobile treating machine of claim 4 further comprising, in combination: means for removably interconnecting the handle of the first treating member manipulating means with the handle of the second treating member manipulating means.

6. The mobile treating machine of claim 5 wherein the removably interconnecting means comprises, in combination: a plunger moveably mounted in the handle of the first treating member manipulating means between a first, interlocking position with the handle of the second treating member manipulating means and a second, noninterlocking position with the handle of the second treating member manipulating means.

7. The mobile treating machine of claim 6 further comprising, in combination: means for biasing the plunger from the first, interlocking position into the second, noninterlocking position.

8. The mobile treating machine of claim 7 wherein the handles include a tube arranged generally parallel to the pivot axis of the handle, with the tube having an open inner end, with the plunger being slideably mounted in the tube of the handle of the first treating member manipulating means to extend out of the open end of the tube and into the open end of the tube of the handle of the second treating member manipulating means in the first, interlocking position; and means for manually sliding the plunger in the tube of the handle of the first treating member manipulating means.

9. The mobile treating machine of claim 8 wherein the manually sliding means comprises, in combination: an elongated slot formed in the tube of the handle of the first treating member manipulating means; and a knob attached to the plunger and extending out of the elongated slot.

10. The mobile treating machine of claim 9 wherein the biasing means comprises a tension spring having a first end connected to the plunger and a second end connected to the tube of the handle of the first treating member manipulating means.

11. The mobile treating machine of claim 10 further comprising, in combination: grip members slideably received on the opposite ends of the tube of the handles of the first and second treating member manipulating means.

12. The mobile treating machine of claim 11 wherein the axis of the first legs of the levers of the first and second treating member manipulating means are mounted for movement relative to the chassis for raising and lowering the first and second treating members relative to the surface.

13. The mobile treating machine of claim 8 wherein the biasing means comprises a tension spring having a first end connected to the plunger and a second end connected to the tube of the handle of the first treating member manipulating means.

14. The mobile treating machine of claim 1 wherein the manipulating means comprises, in combination: a lever having a first leg, with the lever being pivotally mounted about its first leg, with the rotatable treating member being pivotally connected to the first leg about a connection axis generally perpendicular to the rotation axis of the treating member and to the first leg; and means for pivoting the lever about its first leg.

15. The mobile treating machine of claim 14 wherein the treating members are rotatably mounted in a bearing block, with the first treating member being pivotably connected to the lever by a C-shaped yoke, with the free ends of the legs of the yoke being adjustably pivotably mounted to the first leg of the lever along an axis generally perpendicular to the first leg of the lever and generally parallel to the rotation axis of the first treating member, and a spherical rod end adjustably secured to the bearing block of the first treating member and being pivotably connected to the central portion of the yoke about the connection axis, with the second treating member being connected to the lever by a spherical rod end adjustably secured to the bearing block of the second treating member and being pivotably connected to the first leg of the lever about the connection axis.

* * * * *